US007788895B2

(12) United States Patent
Fujii

(10) Patent No.: US 7,788,895 B2
(45) Date of Patent: Sep. 7, 2010

(54) FLASHBACK-DETECTING EQUIPMENT, FLASHBACK-DETECTING METHOD AND GAS TURBINE

(75) Inventor: Kentaro Fujii, Hyogoken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 984 days.

(21) Appl. No.: 11/480,555

(22) Filed: Jul. 5, 2006

(65) Prior Publication Data

US 2007/0006596 A1 Jan. 11, 2007

(30) Foreign Application Priority Data

Jul. 8, 2005 (JP) ..... 2005-199846

(51) Int. Cl.
*F02G 3/00* (2006.01)

(52) U.S. Cl. ..... 60/39.091; 60/772

(58) Field of Classification Search ..... 60/39.091, 60/772, 779, 803, 39.094; 431/13, 14, 15; 220/749, 745–750
See application file for complete search history.

(56) References Cited

U.S. PATENT DOCUMENTS

| | | | | |
|---|---|---|---|---|
| 3,558,249 | A | 1/1971 | Cope | |
| 5,676,712 | A | 10/1997 | Anderson | |
| 5,961,314 | A * | 10/1999 | Myhre et al. | 431/79 |
| 6,003,296 | A * | 12/1999 | Citeno et al. | 60/772 |
| 6,357,216 | B1 * | 3/2002 | Scott et al. | 60/779 |
| 6,429,020 | B1 * | 8/2002 | Thornton et al. | 436/153 |
| 2002/0029557 | A1 * | 3/2002 | Tobo et al. | 60/39.091 |

FOREIGN PATENT DOCUMENTS

| | | | |
|---|---|---|---|
| EP | 0 816 760 | A1 | 1/1998 |
| JP | 5-322169 | A | 12/1993 |
| JP | 7-54671 | A | 2/1995 |
| JP | 08-110050 | | 4/1996 |
| JP | 11-101134 | | 4/1999 |
| JP | 2000-018050 | | 1/2000 |
| JP | 2001-108237 | | 4/2001 |
| JP | 2001-108237 | A | 4/2001 |
| JP | 2001-263092 | A | 9/2001 |
| JP | 2004-324548 | | 11/2004 |
| TW | 233482 | B | 6/2005 |

* cited by examiner

*Primary Examiner*—Michael Cuff
*Assistant Examiner*—Vikansha S Dwivedi
(74) *Attorney, Agent, or Firm*—Westerman, Hattori, Daniels & Adrian, LLP

(57) ABSTRACT

When a temperature of cooling steam being measured by a temperature-measuring device 13 in one combustor 2-*x* among combustors 2-1 through 2-8 is confirmed to be higher than a temperature of a predetermined time before by a predetermined value and temperatures of cooling steams being measured by temperature-measuring devices 13 in combustors 2-*y* and 2-*z* being adjacent to the combustor 2-*x* on both sides are confirmed to be lower than a temperature of a predetermined time before by a predetermined value, an occurrence of a flashback is detected in the combustor 2-*x*.

5 Claims, 4 Drawing Sheets

FLASHBACK-DETECTING EQUIPMENT, FLASHBACK-DETECTING METHOD AND GAS TURBINE

The present invention is based on the Japanese Patent Application applied as No. 2005-199846 on Jul. 8, 2005, the contents of which are hereby incorporated by reference.

BACKGROUND OF THE INVENTION

1. Field of the Invention

The present invention relates to a flashback-detecting equipment and a flashback-detecting method which detect a flashback occurring during combustion of a combustor, and especially, relates to a flashback-detecting equipment and a flashback-detecting method which detect a flashback in a combustor being cooled by a cooling fluid.

2. Description of the Prior Art

In recent years, in order to reduce air pollution, at electric generation facilities utilizing gas turbines, it is demanded to reduce NOx being included in exhaust gas thereof. NOx in a gas turbine is generated in a combustor which performs combustion in order to rotate a gas turbine. Therefore, conventionally, in order to reduce NOx being generated in a combustor, is employed a combustor being provided with main nozzles that perform combustion (premixed combustion) by mixing a fuel with the air.

By having the main nozzles perform premixed combustion, it is possible to reduce the amount of NOx being exhausted from the combustor. However, combustion state thereof is unstable, and combustion vibrations occur. Therefore, in order to restrain the combustion vibrations so as to make the combustion state stable, such a combustor is employed as is further equipped with a pilot nozzle which diffuses and burns a fuel (diffusion combustion). FIG. 5 shows a schematic block diagram of a combustor being provided with a pilot nozzle and main nozzles as described hereinabove.

Around a pilot nozzle 101 being provided with a cone for forming a diffusion flame by having the pilot fuel and combustion air react, a combustor in FIG. 5 is provided with a plurality of main nozzles 102 producing and injecting a premixture gas of a main fuel and combustion air so as to generate a premixed flame. Then, the combustor in FIG. 5 comprises a combustor basket 103 having a pilot nozzle 101 and main nozzles 102 inserted therein and a transition piece 104 which has the combustor basket inserted therein and discharges combustion gas. By being provided with the main nozzles 102 in this manner, combustion of pre-mixture gas controls the combustion temperature so as to heat the combustion gas being discharged from the transition piece 104 up to high temperature. In order to deal with heating of the combustion gas to attain high temperature, the present applicant provided a combustor being equipped with a cooling structure that cools the transition piece with cooling steam. (See the Japanese Patent Applications Laid-Open No. 2001-263092.)

However, in premixed combustion burning a gaseous premixture, a range of stable combustion is narrow, and by a change in flow rate and fluctuation of fuel-air ratio due to an increase or a decrease in flow volume of the gaseous premixture, a location where the premixed flame is formed is shifted to upstream side, thereby generating a flashback phenomenon. In order to detect a flashback, there is a flashback-detecting sensor which detects a flashback by detecting an outlet temperature of a combustor. However, because combustion gas being discharged is heated to high temperature, an available location to install a flashback-detecting sensor is limited. In addition, even though each sensor serving as a flashback sensor is installed to the limited location, it is difficult to detect a flashback properly because each sensor does not directly detect a flashback.

SUMMARY OF THE INVENTION

It is an object of the present invention to provide a flashback-detecting equipment which can detect a flashback in an accurate manner by detecting a change in temperature of a cooling fluid which cools a combustor.

In order to achieve the above object, a flashback-detecting equipment in accordance with the present invention detects a flashback in a combustor injecting combustion gas being obtained by burning a supplied fuel; wherein, are provided a temperature-measuring device which measures a temperature of a cooling fluid circulating so as to cool a chassis composing the combustor and a flashback-detecting portion which detects an occurrence of a flashback in the combustor based on the temperature of the cooling fluid being measured with the temperature-measuring device.

A flashback-detecting method in accordance with the present invention is a method to detect a flashback in a combustor that injects combustion gas being obtained by burning a supplied fuel, comprising a first step to measure a temperature of a cooling fluid circulating so as to cool a chassis composing the combustor and a second step to detect an occurrence of a flashback in the combustor based on the temperature of the cooling fluid being measured.

A gas turbine in accordance with the present invention comprises a compressor compressing the air from outside; a plurality of combustors burning a fuel with compressed air from the compressor; a turbine being rotated by combustion gas from the combustor and sharing a same shaft with the compressor; and the aforementioned flashback-detecting equipment; wherein, the flashback-detecting equipment detects the temperature of a cooling fluid that cools each of the plurality of combustors, respectively, and an occurrence of a flashback is detected based on the detected temperature of the cooling fluid.

In accordance with the present invention, a flashback is detected based on the temperature of a cooling fluid. Therefore, compared with directly detecting the combustion gas temperature, it is possible to lower the temperature atmosphere in a position where a temperature-detecting device is installed. As a result, it is possible to detect a flashback correctly, corresponding to heating of the combustion gas from a combustor. In addition, by confirming a change in temperature of the cooling fluid in the target combustor and in the adjacent combustors, it is possible to detect a flashback more correctly. Moreover, by having an occurrence of a flashback detected when the condition of a change that is assumed to have a flashback occur is continuously confirmed for a predetermined time, this flashback-detecting behavior can be made more accurate.

DESCRIPTION OF THE PREFERRED EMBODIMENTS

Figure 1:
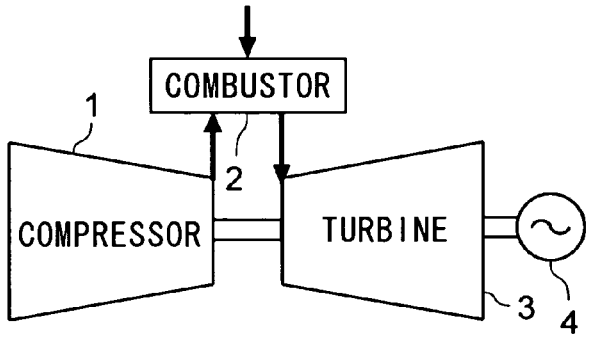
FIG. 1 is a block diagram showing a construction of a gas turbine.
Figure 2:
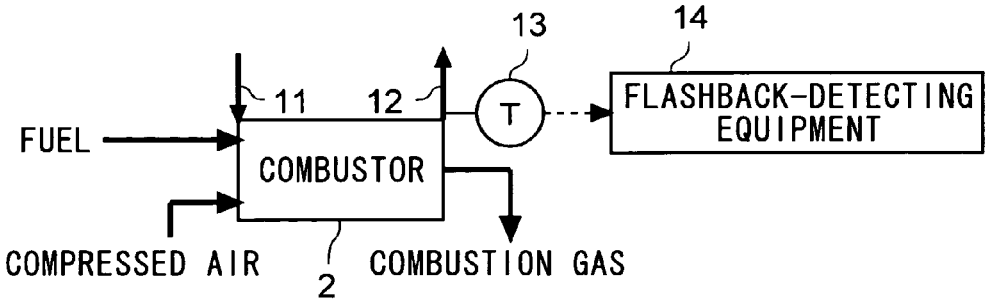
FIG. 2 is a diagram showing a relation between a flashback-detecting equipment and a cooling structure of a combustor in accordance with an embodiment of the present invention.

Referring now to the drawings, an embodiment of the present invention will be described hereinafter. FIG. 1 is a block diagram showing a construction of a gas turbine. FIG. 2 is a schematic block diagram showing a relation between a cooling structure of a combustor and a flashback-detecting equipment in a gas turbine of FIG. 1.

A gas turbine in FIG. 1 comprises a compressor 1 compressing an air being supplied from outside; a combustor 2 burning a fuel with the compressed air from the compressor 1 and injecting combustion gas; and a turbine 3 being rotary driven by combustion gas from the combustor. In such a gas turbine as described hereinabove, the compressor 1 and the turbine 3 are connected by a same shaft, and the compressor 1 is rotated by rotation of the turbine 3 and compresses the air. In addition, by having a generator 4 being connected to the turbine 3 by a same shaft, the generator 4 performs electrical power generation by rotation of the turbine 3.

Figure 5:
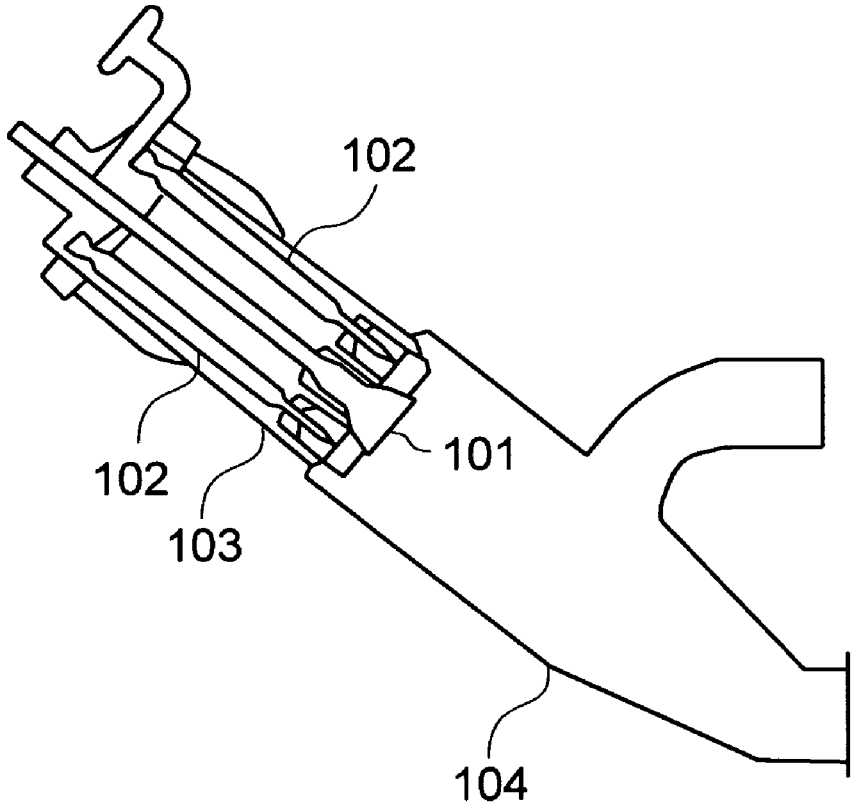
FIG. 5 is a schematic diagram showing a construction of a combustor.

In a gas turbine constructed in such a manner as described hereinabove, FIG. 1 depicts only one unit of a combustor 2, but a plurality of units of combustors are provided so as to be equally spaced circumferentially of a shaft connecting the compressor 1 and the turbine 4. Then, the combustor 2, as shown in FIG. 5, have diffusion combustion and pre-mixed combustion performed by a pilot nozzle 101 and main nozzles 102, respectively, wherein, a combustor basket 103 having the pilot nozzle 101 and the main nozzles 102 inserted therein is inserted into a transition piece 104. Moreover, the transition piece 104 of the combustor 2 is cooled by having water vapor (cooling steam) serving as a cooling fluid flow so as to circulate around the wall surface.

A flashback can be detected by installing a temperature-measuring device such as a thermocouple and the like to a cooling structure which cools a combustor 2 by having a cooling steam flow around the wall surface of the transition piece 104. At this time, as shown in FIG. 2, the cooling steam is supplied to the combustor 2 from a cooling steam supply pathway 11, circulates around the wall surface of the transition piece 104 of the combustor 2, cools the combustor 2, and subsequently, is recovered from the cooling steam recovery pathway 12. Then, a temperature-measuring device 13 which measures the temperature of the cooling steam being recovered from the cooling steam recovery pathway 12 is installed to the cooling steam recovery pathway 12. A measuring signal indicating the temperature of the cooling steam of each combustor 2 being measured with the temperature-measuring device 13 is supplied to a flashback-detecting portion 14, wherein the flashback-detecting portion 14 confirms a change in temperature of the cooling steam of each combustor 2, thereby detecting a combustor 2 in which a flashback occurs.

Figure 3:
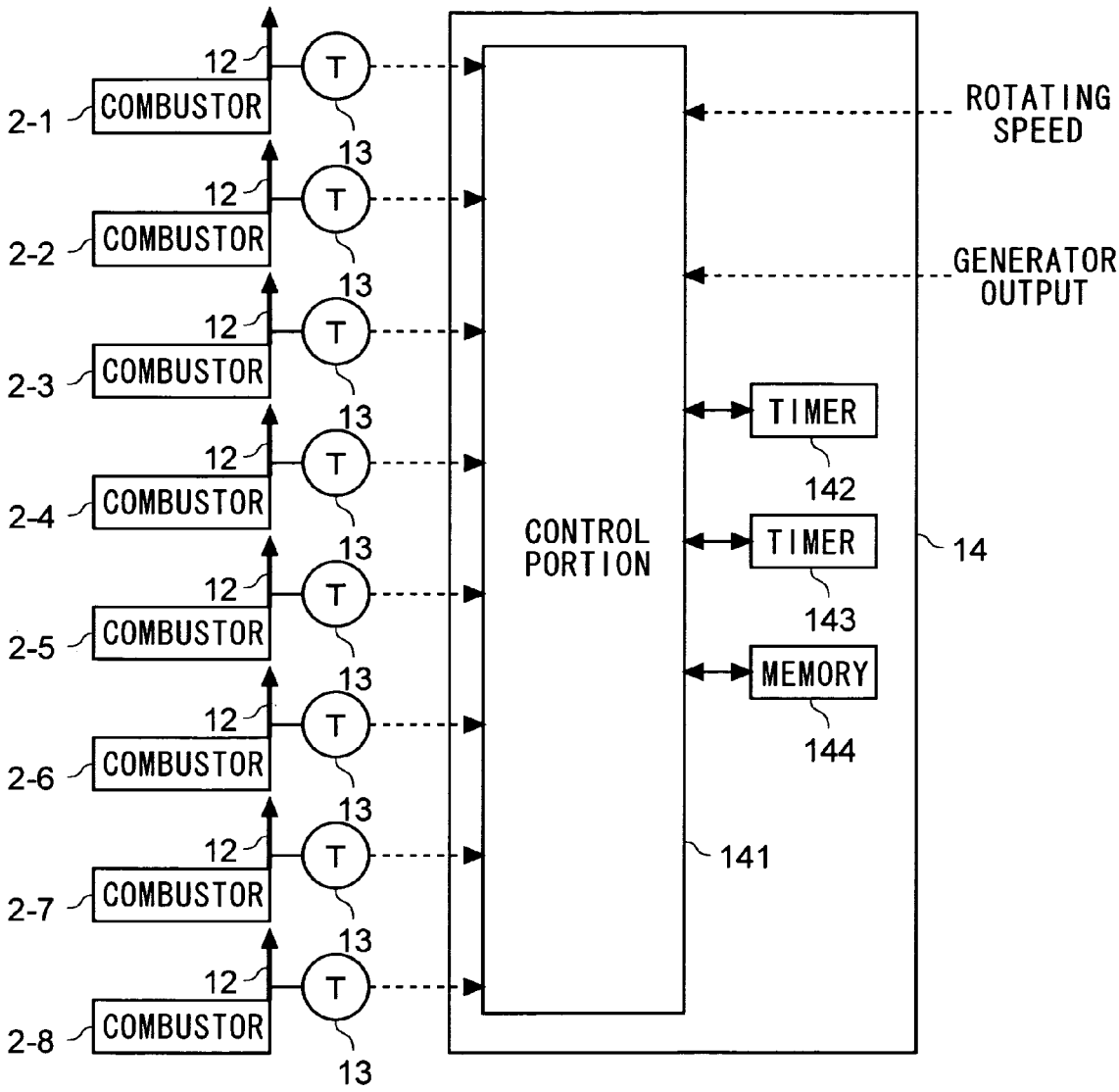
FIG. 3 is a diagram showing a construction of a flashback-detecting equipment of FIG. 2.

As shown in FIG. 3, when being constructed as FIG. 2, a flashback-detecting equipment is composed of temperature-measuring devices 13 being provided to a plurality of combustors 2-1 through 2-8, respectively, and a flashback-detecting portion 14. In addition, in an example of FIG. 3, eight units of combustors 2-1 through 2-8 are provided to a gas turbine. Moreover, the flashback-detecting portion 14 in a flashback-detecting equipment is supplied with a signal indicating a rotating speed of the turbine 3 and a signal indicating an output from the generator 4.

Figure 4:
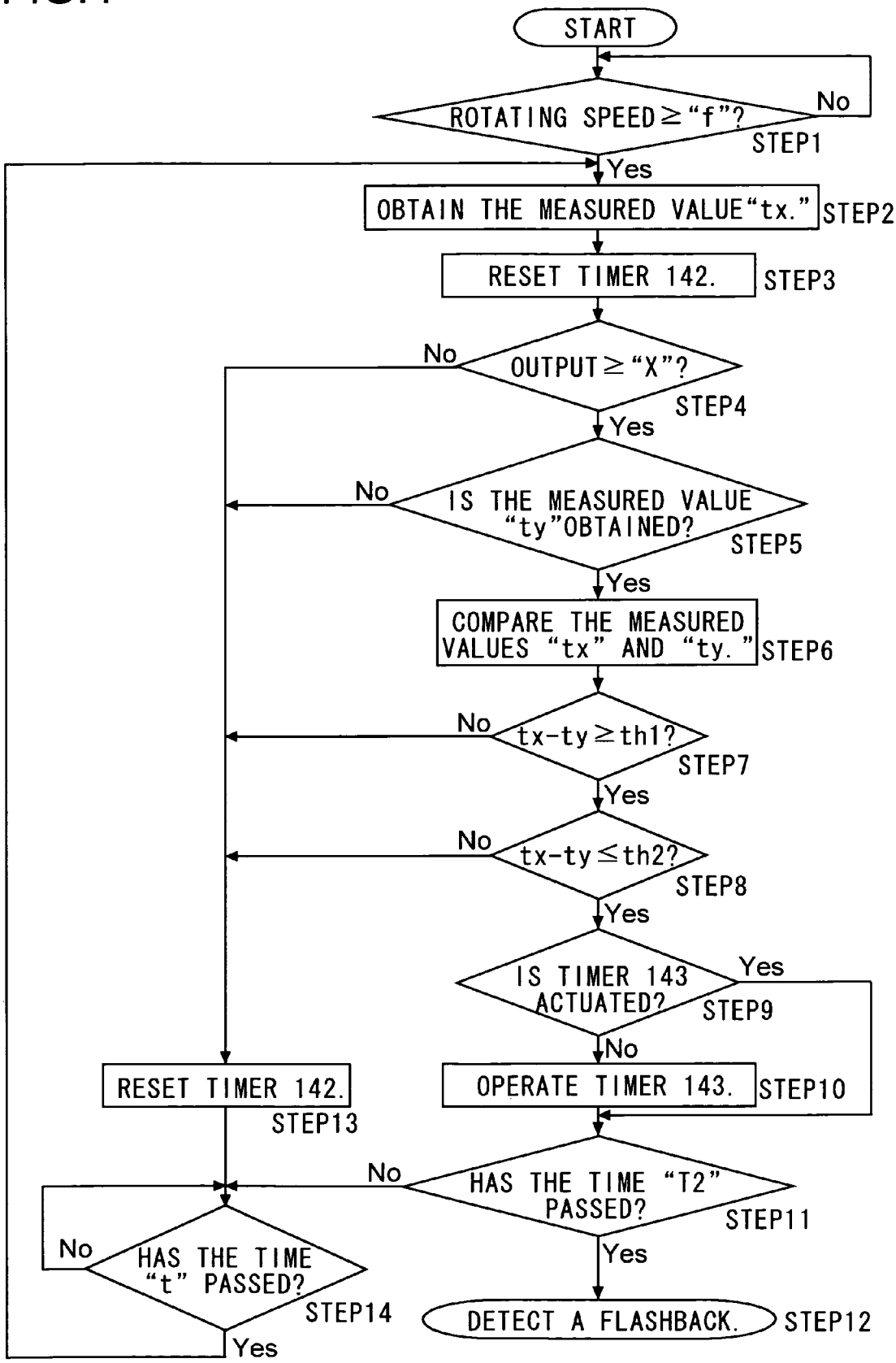
FIG. 4 is a flow chart showing behaviors of a flashback-detecting equipment of FIG. 2.

The flashback-detecting portion 14 comprises a control portion 141 which is provided with signals from the temperature-measuring portions 13 of the combustors 2-1 through 2-8, respectively, and signals indicating the rotating speed of the gas turbine 3 and the output of the generator 4 and detects a flashback; a timer 142 which measures the time to obtain signals from the temperature-measuring portions 13 of the combustors 2-1 through 2-8, respectively; a timer 143 which measures the time in which the condition of each of the combustors 2-1 through 2-8 continues in a predetermined condition; and a memory 144 which memorizes the measured values of the temperature-measuring portions 13 of the combustors 2-1 through 2-8, respectively. Such behaviors of a flashback-detecting equipment as described hereinabove will be explained hereinafter by referring to the drawings. FIG. 4 is a flow chart showing behaviors of a flashback-detecting equipment.

When the turbine 3 of a gas turbine is rotary driven, in the control portion 141 of a flashback-detecting portion 14, the rotating speed of the turbine 3 is confirmed so as to determine whether the rotating speed of the turbine 3 is over a predetermined rotating speed "f" or not. (STEP 1) Specifically, by confirming if the rotating speed of the turbine 3 is within a range of speed increase, it is confirmed whether the rated rotating speed range is attained or not. Then, when the confirming behavior in STEP 1 is performed until the predetermined rotating speed "f" is exceeded, and the predetermined rotating speed "f" is attained ("Yes"), the temperature-measuring devices 13 measure the temperature of the cooling steam being recovered from the cooling steam recovery pathways 12 of the combustors 2-1 through 2-8, respectively. (STEP 2) At this time, the measured values "tx" being obtained by the temperature-measuring devices 13 of the combustors 2-1 through 2-8, respectively, are provided to the control portion 141 of the flashback-detecting portion 14 and memorized as log values in the memory 144 of the flashback-detecting portion 14.

Subsequently, in the flashback-detecting portion 14, after initializing the timer 142 measuring the time to obtain the measured values by the temperature-measuring devices 13 of the combustors 2-1 through 2-8, respectively (STEP 3), the control portion 141 confirms whether the output from the generator 4 is over the predetermined output "X" (70 MW, for example) or not. (STEP 4) In addition, the predetermined output "X" is set to be a minimum output which has a possibility that a flashback may occur. Then, when the output from the generator 4 is confirmed to be over the predetermined output "X" ("Yes"), it is confirmed whether or not the memory 144 has the log values "ty" therein that are measured by the temperature-measuring devices 13 and memorized for the combustors 2-1 through 2-8, respectively, the time "T1" (for example, thirty seconds) before. (STEP 5) When the measured log values "ty" for the combustors 2-1 through 2-8, respectively, are memorized in the memory 144 ("Yes"), differences ("tx"−"ty") between the measured log values "ty"

being retrieved from the memory 144 and the measured values "tx" being obtained at present by measurement with the temperature-measuring devices 13 in STEP 2 are obtained by the control portion 141 for the combustors 2-1 through 2-8, respectively. (STEP 6)

Then, the control portion 141 confirms whether the differences ("tx"−"ty") of the measured values being obtained for the combustors 2-1 through 2-8, respectively are over the predetermined value "th1" (4° C., for example) or not. (STEP 7) Here, when such a combustor 2-*x* (indicating any of the combustors 2-1 through 2-8) is confirmed as has a difference of the measured values ("tx"−"ty") being over "th1," the control portion 141 confirms whether or not the differences between the measured values ("tx"−"ty") for two combustors 2-*y* (any of the combustors 2-1 through 2-8 excluding the combustor 2-*x*) and 2-*z* (any of the combustors 2-1 through 2-8 excluding the combustors 2-*x* and 2-*y*) being adjacent to the combustor 2-*x* on both sides thereof against the circumferential direction of the gas turbine shaft are "th2" (−1 C.°, for example) or less. (STEP 8)

Moreover, when the differences of the measured values ("tx"−"ty") are confirmed to be "th2" or less in the combustors 2-*y* and 2-*z* being adjacent to the combustor 2-*x* on both sides thereof in STEP 8 ("Yes"), the control portion 141 confirms whether the time-measuring behavior is started or not by the timer 143 which measures the time in which such a condition continues as the measured temperature by the temperature-measuring portion 13 of the combustor 2-*x* is higher than the temperature of thirty seconds earlier by over "th1" and the measured temperatures by the temperature-measuring portions 13 of the combustors 2-*y* and 2-*z* are lower than the temperature of thirty seconds earlier by over "th2." (STEP 9) Here, when it is confirmed that the timer 143 does not measure the time ("No"), the timer 143 starts measuring the time. (STEP 10)

Then, when it is confirmed in STEP 9 that the timer 143 measures the time ("Yes"), or when the timer 143 starts measuring the time in STEP 10, the control portion 141 confirms whether the time measured by the timer 143 has passed for the predetermined time "T2" (8 seconds, for example) or not. (STEP 11) Specifically, the control portion 141 confirms whether or not such a condition continues for the predetermined time "T2" as the measured temperature by the temperature-measuring portion 13 of the combustor 2-*x* is higher than the temperature of the predetermined time "T1" earlier by over "th1" and the measured temperatures by the temperature-measuring portions 13 of the combustors 2-*y* and 2-*z* are lower than the temperature of the predetermined time "T1" earlier by over "th2."

At this time, when the timer 143 confirms that the predetermined time "T2" has passed ("Yes"), the flashback-detecting portion 14 detects that a flashback has occurred in the combustor 2-*x*. (STEP 12) When it is detected in such a manner as described hereinabove that a flashback has occurred, the flashback-detecting portion 14 either generates an alarm indicating an occurrence of a flashback, or automatically reduces the load of a turbine 3 or shuts down the turbine 3 by changing the fuels of the combustors 2.

Additionally, when the output of the generator 4 does not attain the predetermined output "X" in STEP 4 ("No"), or when the measured log value "ty" being previous for the time "T1" is not memorized in the flashback-detecting portion 14 in STEP 5 ("No"), or when such a combustor 2-*x* is not confirmed in STEP 7 as has a difference of the measured values ("tx"−"ty") being more than the predetermined value "th1" ("No"), or when the differences between the measured values ("tx"−"ty") of the combustors 2-*y* and 2-*z* being adjacent to the combustor 2-*x* on both sides are larger than the predetermined value "th2" ("No") in STEP 8, the timer 142 is initialized. (STEP 13)

Then, when the time measured by the timer 143 does not attain the predetermined time "T2" in STEP 11 ("No"), or when the timer 142 is initialized in STEP 13, the control portion 141 confirms whether the time measured with the timer 142 has passed for a predetermined time "t" ("t"<"T2") or not. (STEP 14) Then, confirmation of the time being measured by the timer 142 in STEP 10 is performed until the time "t" passes, and when the lapse of the time "t" is confirmed ("Yes"), performance is shifted to STEP 2 and the behaviors after STEP 2 will be repeated.

By behaving in such a manner as described hereinabove, when the temperature of the cooling steam of each of the combustors 2-*y* and 2-*z* being adjacent to the combustor 2-*x*, in which the temperature of the cooling steam is higher than the temperature of the cooling steam of the time "T1" earlier by over "th1," is lower than the temperature of the cooling steam of the time "T1" earlier by over "th2" and this condition of the combustors 2-*x* through 2-*z* continues for the time "T2," the flashback-detecting equipment confirms an occurrence of a flashback in the combustor 2-*x*. At this time, because an occurrence of a flashback is confirmed while the condition of the combustors 2-*x* through 2-*z* continues for the time "T2," an occurrence of a flashback can be confirmed more accurately without being affected by high-frequency constituents such as noises overlapping the signals from the temperature-measuring portions 13.

What is claimed is:

1. A flashback-detecting method for a gas turbine having at least one combustor which discharges combustion gas, the method comprising:

a first step of measuring a temperature of a cooling fluid circulating so as to cool the combustor; and a second step of detecting an occurrence of a flashback in the combustor based on the temperature of the cooling fluid measured in the first step.

2. The flashback-detecting method for a gas turbine according to claim 1, wherein the second step includes a third step of confirming that a first temperature of the cooling fluid discharged from the combustor being measured at the present moment in the first step is higher than a second temperature of the cooling fluid measured in a first predetermined amount of time before the present moment by a first predetermined temperature or more.

3. The flashback-detecting method for a gas turbine according to claim 1, the gas turbine having a plurality of combustors located at equally-spaced intervals, wherein the second step includes:

a fourth step of confirming that a third temperature of the cooling fluid discharged from a first combustor included in the combustors being measured at the present moment in the first step is higher than a fourth temperature of the cooling fluid measured in a first predetermined amount of time before the present moment by a first predetermined temperature or more; and a fifth step of confirming that a fifth temperature of the cooling fluid discharged from second combustors on both sides of the first combustor being measured at the present moment in the first step is higher than a sixth temperature of the cooling fluid measured in the first predetermined amount of time before the present moment by a second predetermined temperature or more.

4. The flashback-detecting method for a gas turbine according to claim 2, wherein the second step includes a sixth step of confirming that a condition in which the first temperature is higher than the second temperature by the first predetermined temperature or more continues during a second predetermined amount of time.

5. The flashback-detecting method for a gas turbine according to claim 3, wherein the second step includes:

a seventh step of confirming that a condition in which the first temperature is higher than the second temperature by the first predetermined temperature or more continues during a second predetermined amount of time; and an eighth step of confirming that a condition in which the third temperature is higher than the fourth temperature by the second predetermined temperature or more continues during the second predetermined amount of time.

* * * * *